United States Patent [19]

Tomayko et al.

[11] Patent Number: 4,598,559

[45] Date of Patent: Jul. 8, 1986

[54] REVERSIBLE FIXED VANE ROTARY COMPRESSOR HAVING A REVERSING DISK WHICH CARRIES THE SUCTION PORT

[75] Inventors: Edward A. Tomayko, Cuyler; Prakash N. Pandeya, Clay, both of N.Y.

[73] Assignee: Carrier Corporation, Syracuse, N.Y.

[21] Appl. No.: 739,786

[22] Filed: May 31, 1985

[51] Int. Cl.[4] ..... F25B 13/00; F04C 18/00

[52] U.S. Cl. ..... 62/324.6; 418/63; 418/133; 418/159; 418/1

[58] Field of Search ..... 418/1, 15, 63, 133, 418/159; 417/410, 326, 902, 53; 62/324.1, 324.6, 160, 508

[56] References Cited

U.S. PATENT DOCUMENTS

| | | | |
|---|---|---|---|
| 2,844,945 | 7/1958 | Muffly | 418/15 X |
| 3,723,024 | 3/1973 | Sawai et al. | 418/159 |
| 3,985,473 | 10/1976 | King et al. | 418/248 X |
| 4,367,638 | 1/1983 | Gray | 418/63 X |
| 4,445,344 | 5/1985 | Ladusaw | 418/63 X |

FOREIGN PATENT DOCUMENTS

| | | | |
|---|---|---|---|
| 2508287 | 9/1975 | Fed. Rep. of Germany | 418/63 |
| 21610 | 2/1979 | Japan | 418/15 |

*Primary Examiner*—William L. Freeh
*Assistant Examiner*—Paul F. Neils
*Attorney, Agent, or Firm*—David J. Zobkiw

[57] ABSTRACT

The reversing of the direction of rotation of the motor of a fixed vane rotary compressor reverses the direction of rotation of the rolling piston. The rolling piston through viscous friction or frictional torque frictionally engages a reversing disk and causes the reversing disk to move between two positions depending upon the direction of rotation of the rolling piston. The reversing disk has a slot therein which forms the suction inlet and is moved by rotation of the reversing disk so as to be in fluid communication with the plenum which is serving as the suction plenum at that time.

4 Claims, 8 Drawing Figures

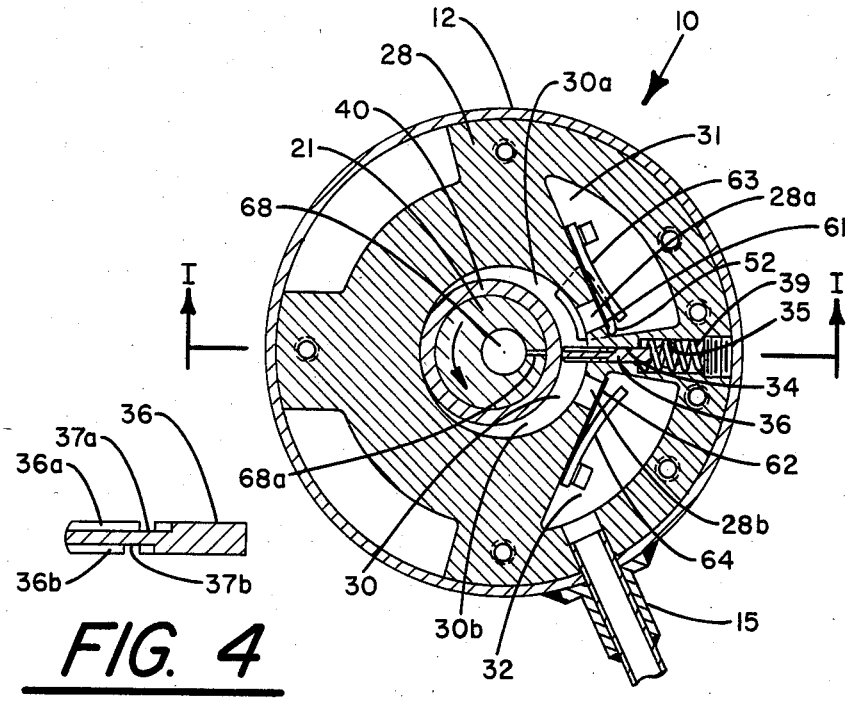
FIG. 4
FIG. 2
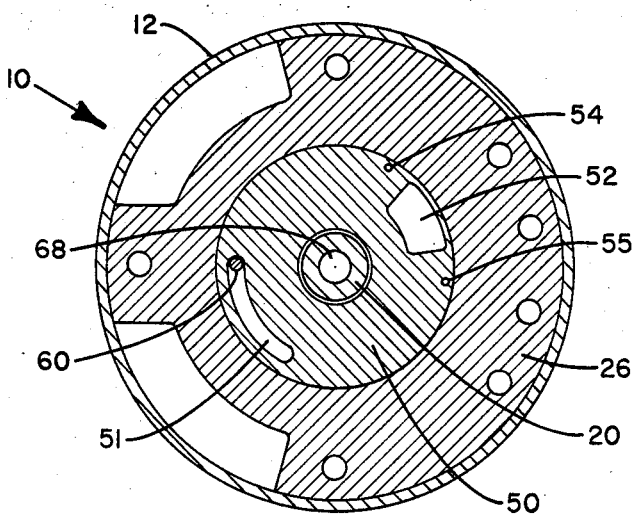
FIG. 3

REVERSIBLE FIXED VANE ROTARY COMPRESSOR HAVING A REVERSING DISK WHICH CARRIES THE SUCTION PORT

BACKGROUND OF THE INVENTION

In heat pump applications, the switchover from the heating to the cooling mode, and vice versa, reverses the direction of flow for the refrigerant such that the coils serving as the condenser and evaporator, respectively, reverse functions. Where the compressor operates in a single direction, the change in the direction of the flow is generally achieved through a valving arrangement located externally of the compressor. If the compressor itself is reversible, it can be selectively run in either direction to, thereby, achieve the desired direction of flow. The simple reversal of the motor and, thereby, the compressor is not, in and of itself, sufficient to produce a compressor with satisfactory performance in both directions. This unequal performance in both directions is due to the switching between high and low side compressor operation, the change in the cooling requirements and the cooling flow, flow volumes, the reversal of porting function and direction of opening/-closing, etc.

In a fixed vane or rolling piston type of compressor, a cylindrical rolling piston is in linear rolling contact with the cylindrical wall of the piston chamber. The rolling piston is moved by an eccentric located on the crankshaft and has a rolling contact with the wall of the piston chamber and defines therewith a crescent shaped chamber extending for almost 360°. A vane is radially movable and engages the rolling piston so as to divide the crescent shaped chamber into a suction chamber and a discharge chamber with their relative instantaneous volumes depending upon the location of the linear contact between the rolling piston and the wall of the piston chamber.

SUMMARY OF THE INVENTION

In a rotary hermetic compressor of the fixed vane or rolling piston type driven by a reversible motor, the reversing of the motor direction causes the shifting of the port controlling structure. Specifically, a suction port formed in a reversing disk is moved, due to viscous friction through the hydrodynamic oil film separating the disk and the rolling piston, between two positions according to the direction of motor rotation. At each of these two extreme positions the suction port provides a path for suction gas between a plenum and the cylinder suction volume while a second plenum becomes the discharge plenum for the compression volume. The two plenums reverse functions when the motor is reversed. Discharge chamber pressure is used to bias the reversing disk into a metal-to-metal seal with the crankcase.

It is an object of this invention to provide a mechanism and method to enable a reversible fixed vane compressor to efficiently deliver flow in either direction when the direction of motor rotation is reversed.

It is an additional object to provide a compressor that can be reversed simply by reversing the direction of motor rotation.

It is another object of this invention to reduce the clearance between the reversing disk and the bottom surface of the cylinder.

It is an additional object to provide a reversible hermetic compressor having all of the reversing structure within the shell.

It is a further object of this invention to provide a single suction port which is movable responsive to the direction of motor rotation. These objects, and others as will become apparent hereinafter, are accomplished by the present invention.

Basically, the reversal of the direction of rotation of a motor driving a fixed vane or rolling piston compressor reverses the operation of the compressor and thereby the direction of fluid flow. A reversing disk is located beneath the rolling piston and is movable between two positions, depending upon the direction of rotation of the motor, due to viscous frictional forces produced by the moving rolling piston through the oil seal. The reversing disk contains a slot which extends for a radial distance greater than that of the overlying cylinder wall and thereby serves as a suction inlet. In the two positions of the disk, the slot is respectively located on opposite sides of the vane and is in fluid communication with the respective plenums located on either side of the vane. As the vane reciprocates in response to the eccentric movement of the rolling piston, the vane and disk coact to cyclically establish a fluid path to bleed fluid from the discharge chamber to bias the disk into sealing engagement with the crankcase.

BRIEF DESCRIPTION OF THE DRAWINGS

For a fuller understanding of the present invention, reference should now be made to the following detailed description, thereof, taken in conjunction with the accompanying drawings wherein:

FIG. 2 is a sectional view taken along line II—II of FIG. 1;

FIG. 3 is a sectional view taken along line III—III of FIG. 1;

FIG. 4 is a sectional view of the vane taken essentially along line II—II of FIG. 1;

DESCRIPTION OF THE PREFERRED EMBODIMENT

Figure 1:
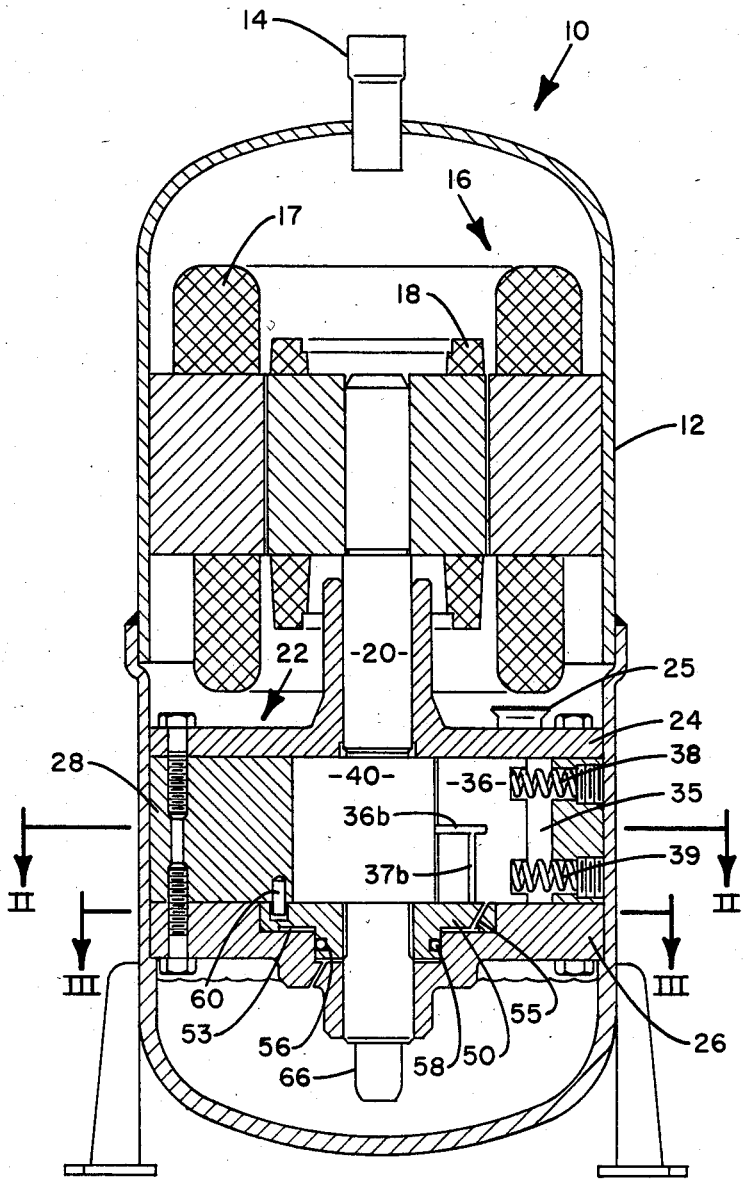
FIG. 1 is a vertical sectional view taken along line I—I of FIG. 2.

In the Figures, the numeral 10 generally designates a hermetic motor-compressor unit having a shell 12. Fluid communication with the interior of shell 12 is via lines 14 and 15, respectively. Within shell 12 is a reversible electric motor 16 including a stator 17 and a rotor 18. Motor 16 can be a conventional reversible electric motor for use in a hermetic compressor. Crankshaft 20 includes an eccentric 21 and is operatively connected to the rotor 18 so as to be rotated therewith, as is conventional. In addition to the crankshaft 20, the compressor 22 includes an upper bearing cap 24 and a lower bearing cap 26 with crankcase 28 located therebetween.

As is best shown in FIG. 2, crankcase 28 defines cylindrical piston chamber 30 and plenums 31 and 32. Crankcase 28 further defines a radially extending vane slot 34 and chamber 35. Vane 36 is reciprocably located in vane slot 34 and chamber 35 and is in essentially fluid tight contact with the walls of slot 34 to prevent leakage across the vane 36. Rolling piston 40 is driven by eccentric 21 so as to roll about the circumference of piston chamber 30 making line contact therewith. Vane 36 is biased into contact with rolling piston 40 by springs 38 and 39. Located beneath rolling piston 40 and a portion of the crankcase 28 and received within a corresponding recess in lower bearing cap 26 is reversing disk 50. The upper face of reversing disk 50 has a pair of arcuate slots 51 and 52 formed therein which serve as part of the rotational limiting structure and the suction inlet, respectively. The lower face of the reversing disk 50 has a circumferential groove 53 formed therein which is in fluid communication with the upper face via circumferentially spaced passages 54 and 55. An annular groove 56 is formed in the lower portion of reversing disk 50 and receives 0-ring 58 therein. A pin 60 is fixedly received in crankcase 28 and extends into slot 51.

Plenums 31 and 32 each contain a discharge valve 61 and 62, respectively, having valve stops 63 and 64, respectively. Preferably valves 61 and 62 and stops 63 and 64 are configured to control passages 28*a* and *b* which are each plural in number. As illustrated, passages 28*a* and *b* are each made up of three openings so that valves 61 and 62 and stops 63 and 64 are "E" shaped to cover each of the openings with a respective one of the "arms" of the "E". Line 15 connects directly with plenum 32. Line 14 fluidly connects with plenum 31 via the interior of shell 12 and passage 25 extending through upper bearing cap 24. As best shown in FIG. 4, on either side of vane 36 is a radially extending groove 36*a* and *b*, respectively, which is in fluid communication with a corresponding axially extending groove 37*a* and *b*, respectively. At the lower end of crankshaft 20 is located an oil pickup tube 66 and an oil galley 68 extends along the axis of crankshaft 20, with radial bearing oil feed holes 68*a*, as is conventional.

In operation, the coaction of the rolling piston 40 and vane 36 is similar to that of a cam and cam follower with the rotation of rolling piston due to eccentric 21 producing reciprocating movement of the vane 36 as rolling piston 40 rolls along the wall of piston chamber 30. Referring now specifically to FIGS. 1–3, the hermetic compressor unit 10 is operating as a low side compressor with line 14 serving as the suction line and line 15 serving as the discharge line. The rotation of the crankshaft and its eccentric 21 is counterclockwise as shown by the arrow in FIG. 2. Refrigerant is drawn into shell 12 via line 14 and passes over and cools the structure of motor 16 before passing via passage 25 into plenum 31 which is serving as the suction plenum. From plenum 31 the refrigerant passes into portion 30*a* of piston chamber 30 via slot 52 in reversing disk 50. While portion 30*a* of piston chamber 30 remains in fluid communication with suction plenum 31 it will be the suction chamber. Once fluid communication with suction plenum 31 is cut off, the trapped volume, as in the case of portion 30*b* of piston chamber 30, becomes the discharge chamber. The discharge chamber 30*b* is in fluid communication with discharge plenum 32 via passages 28*b* under the control of normally closed discharge valve 62. Refrigerant entering discharge plenum 32 is discharged from the compressor via line 15. In rotating, viscous friction in the oil seal between rolling piston 40 and reversing disk 50 would cause continuous movement of disk 50 but for the presence of pin 60 which coacts with slot 51 to limit movement of disk 50 to the angular extent of slot 51 when going in either direction. When the direction of rotation is reversed, the fluid pressure causing the metal-to-metal seal between disk 50 and crankcase 28 must be relieved before the viscous friction is sufficient to move the disk to the other limiting postion.

As noted above, vane 36 reciprocates due to the rotation of the eccentric 21 and thereby rolling piston 40. Referring specifically to FIGS. 1 and 2, it will be noted that outward movement of vane 36 from the illustrated position will establish fluid communication between the current illustrated discharge chamber 30*b* and circumferential groove 53 via groove 36*b*, groove 37*b* and passage 55. Chamber 30*a* will be in the same fluid communication via a corresponding fluid path defined by grooves 36*a*, 37*a* and passage 54 when it is the discharge chamber. The exact moment of the discharge stroke when this fluid communication takes place will be determined by the specific compressor design, but basically it cyclically places groove 53 at essentially discharge pressure to establish a sealing bias of reversing disk 50 against crankcase 28. O-ring 58 acts to prevent leakage from groove 53 as does the interruption of fluid communication between groove 37*b* and passage 55.

Figure 5:
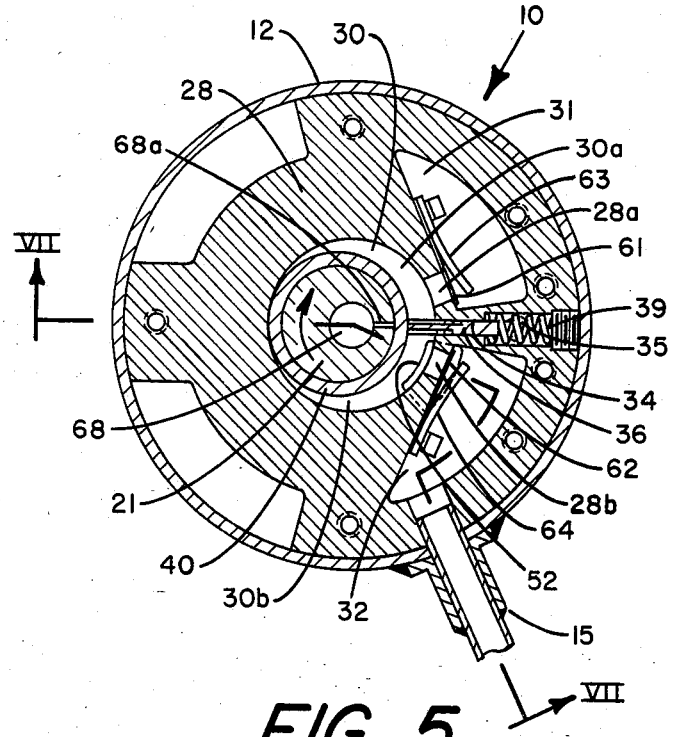
FIG. 5 corresponds to FIG. 2 but with the direction of rotation reversed.
Figure 6:
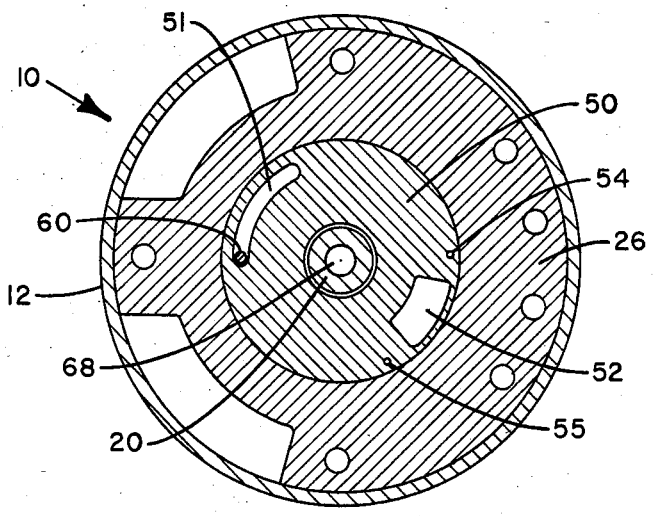
FIG. 6 corresponds to FIG. 3 but with the direction of rotation reversed.

If the motor 16 is reversed so that rotation of the crankshaft and its eccentric 21 is clockwise as shown by the arrow in FIG. 5, rotation of rolling piston 40 by the eccentric 21 will tend to cause disk 50 to move clockwise from the FIGS. 2 and 3 position to the FIGS. 5 and 6 position due to viscous friction. However, the metal-to-metal contact between disk 50 and crankcase 28 initially prevents this so that disk 50 initially remains in the FIGS. 2 and 3 position. The illustrated chamber 30*b* becomes the suction chamber upon reversal of the motor to a clockwise rotation but, until disk 50 is moved to the FIGS. 5 and 6 positions slot 52 is not in the proper position to serve as the suction inlet and chamber 30*b* is therefore at a vacuum. The reciprocation of vane 36 cyclically continues to establish the fluid path defined by grooves 36*b*, 37*b* and passage 55 but the pressure differential causes the bleeding of pressurized fluid from groove 53 to chamber 30*b*. When the fluid pressure in groove 53 drops sufficiently to cause the release of the metal-to-metal seal between disk 50 and crankcase 28, the viscous friction or frictional torque generated between rolling piston 40 and disk 50 is sufficient to turn the disk 50 in the direction of movement of rolling piston 40 to the FIGS. 5 and 6 position which is limited by pin 60 engaging the end of slot 51. In the FIGS. 5 and 6 position, slot 52 is properly placed to serve as the suction inlet and chamber 30*b* is properly supplied. In the FIGS. 5 and 6 position reciprocation of vane 36 cyclically establishes fluid communication between the discharge chamber and groove 53 via grooves 36*a*, 37*a* and passage 54 to establish the metal-to-metal seal between crankcase 28 and disk 50 as previously described.

Figure 7:
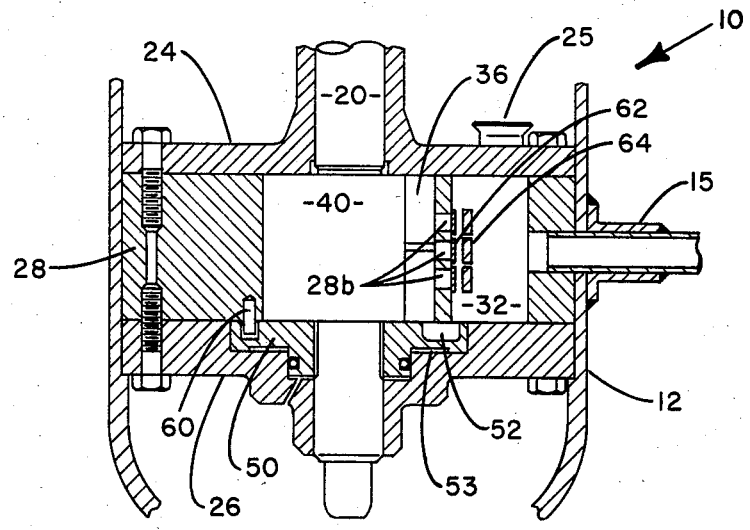
FIG. 7 is a partial sectional view taken along line VII—VII of FIG. 5.
Figure 8:
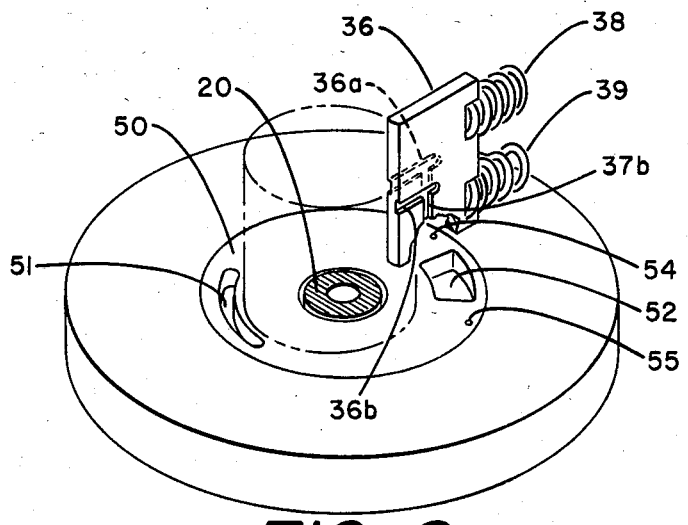
FIG. 8 is an isometric view of the reversing disk and vane structure.

Referring now specifically to FIGS. 5–7, the hermetic compressor unit 10 is operating as a high side compressor with line 15 serving as the suction line and line 14 serving as the discharge line. Refrigerant is drawn into plenum 32, which is acting as the suction plenum, via line 15. Refrigerant discharged from the piston chamber 30 into the plenum 31, which is acting as the discharge plenum, passes via passage 25 into the interior of shell 12 where it passes over the structure of motor 16 before passing from the compressor unit 10 via line 14. More specifically, as shown in FIG. 7, slot 52 provides free fluid communication between suction plenum 32 and piston chamber 30*b* which is acting as the suction chamber and will continue to be the suction chamber as long as it remains in fluid communication with suction plenum 32. Once fluid communication with suction plenum 32 is cut off, the trapped volume, as in the case of portion 30*a* of piston chamber 30, becomes the discharge chamber. The discharge chamber 30*a* is in fluid communication with discharge plenum 31 via passages 28*a* under the control of normally closed discharge valve 61.

As in the low side operation described above, movement of vane 36 will cyclically establish fluid communication between the current illustrated discharge chamber, 30*a*, and circumferential groove 53 via groove 36*a*, groove 37*a* and passage 54. Chamber 30*b* will be in the same fluid communication when it is the discharge chamber. Discharge pressure acting in groove 53 establishes a sealing bias of reversing disk 50 against crankcase 28 as previously described. This sealing bias will be reduced/eliminated upon reversal of motor direction, as described above, to permit movement of the disk 50 by rolling piston 40.

From the foregoing description it should be clear that the same inlet structure is used for both directions of operation which avoids the problems of different volumetric flows in the suction and discharge lines. Similarly, identical discharge valves are used in each direction of operation. The repositioning of the inlet structure is responsive to a viscous friction force produced by the rolling piston which is the structure directly driven by the motor, and is therefore the initial compressor structure which is reversed by reversing the direction of rotation of the motor.

Although a preferred embodiment of the present invention has been illustrated and described, other changes will occur to those skilled in the art. It is, therefore, intended that the present invention is to be limited only by the scope of the appended claims.

What is claimed is:

1. A reversible hermetic compressor unit comprising:

shell means having first and second lines connected thereto;

rotary compressor means within said shell means;

motor means within said shell means for selectively driving said rotary compressor means in a clockwise or a counterclockwise direction;

said rotary compressor means including:

crankcase means defining a cylindrical piston chamber, first plenum means in fluid communication with said piston chamber and said first line, second plenum means in fluid communication with said piston chamber and with said second line via the interior of said shell means, and vane slot means;

rolling piston means in said piston chamber and driven by said motor means so as to maintain a line contact with said piston chamber;

first and second discharge valve means controlling fluid communication between said piston chamber and said first and second plenum means, respectively;

vane means reciprocably located in said vane slot means and extending into said piston chamber so as to sealingly contact said rolling piston means and thereby divide said piston chamber into a pair of chambers which define a suction chamber and a discharge chamber, respectively;

passage means formed on each side of said vane means and respectively providing fluid communication between said pair of chambers and the bottom of the corresponding side of said vane slot;

reversing disk means located beneath said rolling piston and said crankcase means and movable between two positions by coacting with said rolling piston in accordance with the direction of rotation of said rolling piston;

said reversing disk means having a slot in the upper side thereof, a circumferential groove in the lower side thereof, a pair of passage means extending through said disk means into said circumferential groove such that when said disk means is in either one of its two positions, a corresponding one of said pair of passage means is located beneath said vane slot means whereby receprocation of said vane means by said rolling piston means cyclically establishes fluid communication between said discharge chamber and said corresponding one of said passage means so as to provide a fluid pressure bias to said reversing disk means to produce a sealing engagement with said crankcase means.

2. A reversible hermetic compressor unit comprising:

(I) shell means having first and second fluid lines connected thereto with said second fluid line connected to the interior of said shell means;

(II) rotary compressor means within said shell means including:

(a) crankcase means defining a cylindrical piston chamber, a first plenum means which is in fluid communication with said piston chamber and said first fluid line and a second plenum means which is in fluid communication with said piston chamber and the interior of said shell means which provides fluid communication with said second fluid line;

(b) first and second discharge valve means controlling fluid communication between said piston chamber and said first and second plenum means, respectively;

(c) a rolling piston means in said piston chamber and in line contact therewith;

(d) a crankshaft having an eccentric which is drivably connected to said rolling piston means;

(e) a vane means reciprocably extending into said piston chamber from a vane slot in said crankcase means and in sealing contact with said rolling piston means so as to divide said piston chamber into a pair of chambers which define a suction chamber and a discharge chamber, respectively;

(f) reversing disk means, having a slot in the upper side thereof in fluid communication with said piston chamber, and movable by said rolling piston means between two positions in response to the direction of rotation of said rolling piston means such that in said first position said first line is the suction line and said slot provides fluid communication between said first plenum means, which is acting as the suction plenum, and said piston chamber and in said second position said second line is the suction line and said slot provides communication between said second plenum means, which is acting as the suction plenum, and said piston chamber;

(g) a circumferential groove in the lower side of said reversing disk means, and said vane means and said disk means having fluid passage means formed therein which cyclically establish fluid communication between said discharge chamber and said circumferential groove to bias said reversing disk means into sealing engagement with said crankcase means;

(III) motor means within said shell means for selectively driving said crankshaft in either a clockwise or a counterclockwise direction whereby the direction of rotation of said motor means determines which of said first and second fluid lines is a suction line and which is a discharge line.

3. A reversible hermetic compressor unit comprising:

(I) shell means having first and second fluid lines connected thereto with said second fluid line connected to the interior of said shell means;

(II) rotary compressor means within said shell means including:

(a) crankcase means defining a cylindrical piston chamber, a first plenum means which is in fluid communication with said piston chamber and said first fluid line and a second plenum means which is in fluid communication with said piston chamber and the interior of said shell means which provides fluid communication with said second fluid line;

(b) first and second discharge valve means controlling fluid communication between said piston chamber and said first and second plenum means, respectively;

(c) a rolling piston means in said piston chamber and in line contact therewith;

(d) a crankshaft having an eccentric which is drivably connected to said rolling piston means;

(e) a vane means reciprocably extending into said piston chamber from a vane slot in said crankcase means and in sealing contact with said rolling piston means so as to divide said piston chamber into a pair of chamber which define a suction chamber and a discharge chamber, respectively;

(f) reversing disk means, having a slot in the upper side thereof in fluid communication with said piston chamber, and movable by said rolling piston means between two positions in response to the direction of rotation of said rolling piston means such that in said first position said first line is the suction line and said slot provides fluid communication between said first plenum means, which is acting as the suction plenum, and said piston chamber and in said second position said second line is the suction line and said slot provides communication between said second plenum means, which is acting as the suction plenum, and said piston chamber;

(g) passage means formed on each side of said vane means to form respective fluid paths between each of said pair of chambers and said reversing disk means at respective locations beneath said vane slot;

(h) a circumferential groove in the lower side of said disk means; and (i) a pair of passage means respectively located on opposite sides of said slot in said disk means and extending through said disk means into said circumferential groove such that one of said pair of passage means is located beneath said vane slot in each of said two positions of said disck means whereby reciprocation of said vane means by said rolling piston means cyclically establishes fluid communication between said discharge chamber and said circumfernential groove via the passage means formed on the side of said vane means which is in fluid communication with said discharge chamber and the one of said pair of passage means located beneath said vane slot so as to provide a fluid pressure bias to said reversing disk means to produce a sealing engagement with said crankcase means;

(III) motor means within said shell means for selectively driving said crankshaft in either a clockwise or a counter clockwise direction whereby the direction of rotation of said motor means determines which of said first and second fluid lines is a suction line and which is a discharge line.

4. A method of reversibly operating a motor driven rolling piston hermetic compressor unit comprising the steps of:

eccentrically driving a rolling piston so as to maintain a line contact between the rolling piston and the piston chamber;

biasing a reciprocably movable vane into contact with the rolling piston so as to divide the piston chamber into a suction chamber and a discharge chamber;

supplying refrigerant to the suction chamber via a fluid path including a slot in a reversing disk;

biasing the reversing disk into a metal-to-metal seal by cyclically supplying discharge chamber pressure thereto; and upon reversal in the direction of rotation of the motor, relieving the biasing of the reversing disk into a metal-to-metal seal so as to permit movement of the disk by the rolling piston due to viscous friction whereby the slot forming a portion of the fluid path is shifted so as to provide a portion of the fluid path to the current suction chamber and thereafter re-establishing a biasing of the disk into a metal-to-metal seal by cyclically supplying discharge chamber pressure thereto.

* * * * *